US008454142B2

(12) United States Patent
Bannai et al.

(10) Patent No.: US 8,454,142 B2
(45) Date of Patent: Jun. 4, 2013

(54) LIQUID CARRYING CONTAINER AND IMAGE FORMING DEVICE

(75) Inventors: Akiko Bannai, Kanagawa (JP); Toshiroh Tokuno, Tokyo (JP); Shotaro Takeuchi, Kanagawa (JP); Masanori Kusunoki, Tokyo (JP); Tomomi Katoh, Kanagawa (JP); Masahiro Kuwata, Kanagawa (JP); Tadashi Hayakawa, Kanagawa (JP); Ikoh Soh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 370 days.

(21) Appl. No.: 12/870,194

(22) Filed: Aug. 27, 2010

(65) Prior Publication Data

US 2011/0050819 A1 Mar. 3, 2011

(30) Foreign Application Priority Data

Aug. 31, 2009 (JP) ..... 2009-200053

(51) Int. Cl.
*B41J 2/175* (2006.01)

(52) U.S. Cl.
USPC ..... 347/86; 347/85

(58) Field of Classification Search
USPC ..... 347/84, 85, 86, 87
See application file for complete search history.

(56) References Cited

U.S. PATENT DOCUMENTS

| | | | | |
|---|---|---|---|---|
| 5,839,368 | A * | 11/1998 | Ohinata | 101/364 |
| 5,860,363 | A * | 1/1999 | Childers et al. | 101/483 |
| 6,220,702 | B1 * | 4/2001 | Nakamura et al. | 347/86 |
| 6,264,314 | B1 * | 7/2001 | Mochizuki et al. | 347/86 |
| 6,712,458 | B2 * | 3/2004 | Hatasa et al. | 347/86 |
| 6,877,848 | B2 * | 4/2005 | Shimizu et al. | 347/86 |
| 7,325,908 | B2 | 2/2008 | Katoh et al. | |
| 7,377,627 | B2 | 5/2008 | Muranaka et al. | |
| 7,814,732 | B2 * | 10/2010 | Tsuyuki et al. | 53/469 |
| 2004/0046845 | A1 | 3/2004 | Haan et al. | |
| 2005/0157109 | A1 | 7/2005 | Muranaka et al. | |
| 2009/0256892 | A1 | 10/2009 | Takeuchi | |
| 2010/0020142 | A1 | 1/2010 | Bannai et al. | |

FOREIGN PATENT DOCUMENTS

| | | |
|---|---|---|
| CN | 1376585 A | 10/2002 |
| JP | 2-144438 | 12/1990 |
| JP | 2003-89217 | 3/2003 |
| JP | 2004-34696 | 2/2004 |
| JP | 2004-276538 | 10/2004 |
| JP | 2005-59482 | 3/2005 |
| JP | 3919734 | 2/2007 |

OTHER PUBLICATIONS

Chinese official action dated Sep. 14, 2012 in corresponding Chinese patent application No. 201010267450.9.

* cited by examiner

*Primary Examiner* — Anh T. N. Vo
(74) *Attorney, Agent, or Firm* — Cooper & Dunham LLP

(57) ABSTRACT

A liquid carrying container which is removably mounted to a body of an image forming device is disclosed. The liquid carrying container includes a liquid containing bag which contains liquid; and a supply port section which has an elastically deformable portion through which a hollow nozzle member is pierced from the side of the image forming device, wherein the supply port section is directly held within a recess section formed on the liquid containing bag, and the hollow nozzle member penetrates through the supply port section and the liquid containing bag to face inside the liquid containing bag.

18 Claims, 11 Drawing Sheets

BLOWING DIRECTION
102a
104
102
102b

INK FILLING
VENTILATION
104
102
111b 103
102
111a
102
105
111b 103
104
101
111a
102
111b 105

LIQUID CARRYING CONTAINER AND IMAGE FORMING DEVICE

TECHNICAL FIELD

The present invention generally relates to a liquid carrying container and an image forming device and specifically relates to an image forming device having a recording head which discharges a droplet and a liquid carrying container which is removably mounted to the image forming device.

BACKGROUND ART

As an image forming device for a printer, a facsimile, a reproducing unit, a plotter, and a multifunctional unit having these functions, an inkjet recording device is known as a liquid discharge recording-type image forming device using a recording head which discharges an ink droplet, for example.

The liquid discharging recording-type image forming device discharges the ink droplet from the recording head to a sheet to be conveyed (not limited to paper and includes an OHP sheet, representing what the ink droplet and other liquid, etc., can be adhered to; also called a medium to be recorded on, or a recording medium, recording paper, a recording sheet) to perform image forming (recording, print, imaging, printing also used interchangeably). The liquid discharging recording-type image forming device includes a serial-type image forming device which discharges a liquid droplet while the recording head moves in a main scanning direction and a line-type image forming device with the use of a line-type head which discharges an droplet while the recording head does not move to perform image forming.

Herein, a liquid discharging-type "image forming device" represents a device which discharges a droplet to a medium such as paper, thread, fiber, cloth, leather, metal, plastic, glass, wood, ceramics, etc., while "image forming" represents not only providing a medium with an image which has a meaning (e.g., character or graphics), but also providing a medium with an image which does not have a meaning (merely causing a droplet to impact the medium, i.e., a liquid discharging device). Moreover, "ink" is not limited to what is called ink, but all types of liquids which can perform image forming, such as what is called recording liquid, fixing solution, liquid, etc., and includes DNA sample, resist, pattern material, resin, etc., for example.

An image forming device (below called merely "inkjet-type recording device") is known, wherein a sub-tank (also called a buffer tank or a head tank) is mounted on a carriage which has mounted thereto a recording head to which ink is supplied from the sub-tank, a main ink cartridge (also called a main tank) is removably mounted on the side of the image forming device body (merely called "device body" below), and ink is replenished to the sub-tank from the main ink cartridge on the side of the image forming device body.

For example, an ink cartridge is known which tucks into a divided cartridge housing an ink containing bag having the body thereof fixed by welding, etc., to a holding member having an ink supply port section and an ink filling port section and which has the holding member held by a holding unit of the cartridge housing (Patent documents 1 and 2). Moreover, an ink cartridge is also known which includes a casing provided with an opening section at a lower portion of an inner front face and a bag which is collapsible into a sheet-like configuration, a front edge of which bag being connected to a spout fixed to the opening section (Patent document 3).

Moreover, an ink cartridge is known which is structured to directly weld or adhere, to a flexible bag shaped body which stores ink, a rubber-like body into which an aspiration needle may be inserted (Patent document 4).

Moreover, an ink carrying container is disclosed, which is formed of a flexible material, which is held by fixing a supply section within a hard casing, and which is formed by direct blow molding, wherein, in order to reduce the remaining amount of ink, an efficiently collapsible supporting fold is molded with a line-shaped projection section which is formed on an inner face of a metal mold for blow molding (Patent document 5).

Patent document 1: JP3919734
Patent Document 2: JP2004-276538
Patent Document 3: JP2004-034696
Patent document 4: Japanese utility model application publication No. 02-144438
Patent document 5: JP2005-059482

However, as described above, there is a problem that, with an ink cartridge which uses an ink bag whose body has, fixed thereto by welding, etc., a holding member having a supply port section, the number of parts becomes large and that, at the time of welding the holding member and the bag body, etc., dust is likely to find its way therebetween. There is a similar problem with an ink cartridge with the front edge of a bag thereof being connected to a spout.

Moreover, with a structure having a rubber-like body directly welded or adhered to an ink containing section, there is a problem that it is not easy to have the rubber-like body directly welded or adhered when the ink containing section is made of resin with low adherence, so that the durability of the portion in question is not sufficient.

DISCLOSURE OF THE INVENTION

In light of the problems as described above, an object of the present invention is to reduce the number of parts and to make it possible to prevent a contaminant from finding its way into the manufacturing process.

According to an embodiment of the present invention, a liquid carrying container which is removably mounted to a body of an image forming device is provided. The liquid carrying container includes a liquid containing bag which contains liquid; and a supply port section which has an elastically deformable portion through which a hollow nozzle member is pierced from the side of the image forming device, wherein the supply port section is directly held within a recess section formed on the liquid containing bag, and the hollow nozzle member penetrates through the supply port section and the liquid containing bag to face inside the liquid containing bag.

According to another embodiment of the present invention, a liquid carrying container which is removably mounted to a body of an image forming device is provided. The liquid carrying container includes a liquid containing section which is made of a resin material of low adherence and which is formed by blow molding; and a supply port section through which a hollow nozzle member is pierced from the side of the body of the image forming device, wherein the supply port section is welded or adhered to the recess section formed on a wall face of the liquid containing section.

According to a further embodiment of the present invention, a liquid carrying container which is removably mounted to a body of an image forming device is provided. The liquid carrying container includes a liquid containing section which is made of a resin material of low adherence and which is formed by blow molding; and a supply port section through which a hollow nozzle member is pierced from the side of the body of the image forming device, wherein the supply port section is arranged within the recess section formed on a wall face of the liquid containing section, and the supply port section has at least a portion thereof made of an elastic member and the elastic member is tightened with a tightening member from an outer periphery of the recess section while being compressed within the liquid containing section.

According to yet further embodiment of the present invention, an image forming device is provided. The image forming device has removably mounted thereto the liquid carrying container of the previously-described embodiments of the present invention.

The above-described embodiments of the present invention make it possible to reduce the number of parts and to prevent a contaminant from finding its way into the manufacturing process.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

The present invention is not limited to the specifically disclosed embodiments, but variations and modifications may be made without departing from the scope of the present invention.

Figure 1:
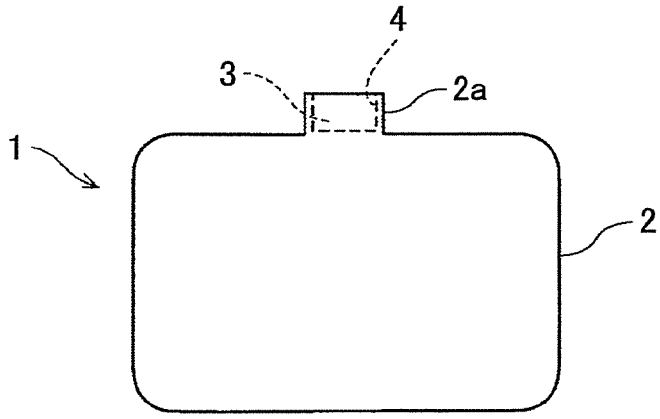
FIG. 1 is a schematic explanatory diagram which serves to explain a first embodiment of an ink cartridge as a liquid carrying container according to the present invention.
Figure 2:
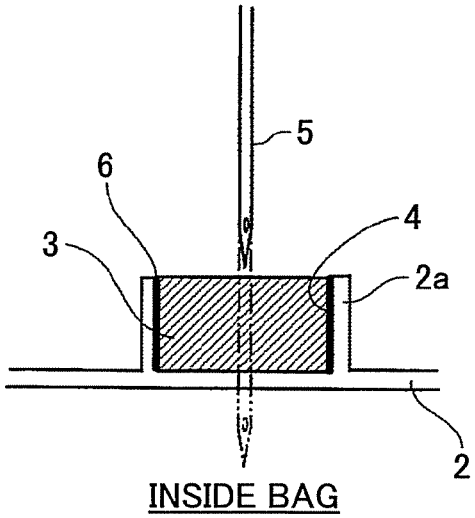
FIG. 2 is a feature cross-section explanatory diagram.

A description is given below with regard to embodiments of the present invention with reference to the drawings. First, a first embodiment of an ink cartridge as a liquid carrying container according to the present invention is explained with reference to FIGS. 1 and 2. FIG. 1 is a schematic explanatory diagram of the ink cartridge, while FIG. 2 is an expanded feature cross section explanatory diagram.

The ink cartridge, an ink cartridge 1, includes an ink containing bag 2 which contains ink and a supply port section 3 having an elastically deformable portion through which a hollow nozzle member 5 is pierced from the side of an image forming device. Then, the supply port section 3 is arranged to be directly held by the ink containing bag 2 such that the hollow nozzle member 5 penetrates through the supply port section 3 and the ink containing bag 2 to face the inside of the ink containing bag 2.

Here, the ink containing bag 2, which is a sealed up bag-shaped member made of a flexible film member, for example, has integrally formed, on the outside thereof, a fit-in section 2*a*, inside which fit-in section 2*a* a recess section 4 is formed, into which recess section 4 the supply port section 3 is to be fitted. Then, the supply port section 3 is fitted into the recess section 4 within the fit-in section 2*a* of the ink containing bag 2, and the fit-in section 2*a* and the supply port section 3 are sealed and joined by welding or adhering (shown as a joining section 6). In this case, for the fit-in section 2*a* of the ink containing bag 2, a film member is preferably made thicker than for the other portions of the ink containing bag 2 to increase the strength.

A material for the ink containing bag 2 is not specifically limited as long as it is a flexible film member. In this case, it may be a film member including one type of resin composition, or a film member having a layer structure including multiple types of resin compositions. Moreover, it may be a structure having a metal thin film layer on the surface or for an intermediate layer. A resin composition is preferably an olefine resin composition and, more specifically, a polyethylene film from a point of view of liquid contactability with respect to ink. Moreover, as the metal thin-film layer, what suppresses moisture permeability of the film, or what provides the rigidity of the film is preferred, and, more specifically, an aluminum thin film, for example, is preferred.

Moreover, while filling in ink into the ink containing bag 2 may be done before joining the ink containing bag 2 and the supply port section 3, or after the joining, it may be done more efficiently after the joining. When the filling in is done after the joining, such a method may be used as a method of drilling a hole at a portion of the ink containing bag 2 to fill in the ink and then closing the hole by heat-seal, etc., or a method of putting in a tubular member of the same composition as the ink containing bag 2 when welding around the ink containing bag 2 to seal up and weld the tubular member, and filling in, therefrom, the ink with a needle-shaped nozzle and then welding the tube as a whole.

The supply port section 3 may be formed of an elastically deformable member as a whole, through which elastically deformable member the hollow nozzle member 5 may be pierced, or may be an elastically deformable member around which a ring-shaped reinforcing member is joined. As the elastically deformable member, a silicone rubber, a fluorine rubber, a butyl rubber, an ethylene-propylene rubber (EPM or EPDM), etc., may be used, for example. Among others, when taking into account liquid contactability with the ink, depending on the composition of the ink, EPDM is preferable for being superior in heat-resistance, weather-resistance, and ozone-resistance. Moreover, for a structure which is to be in contact with the ink over a long term, attention is required also for a vulcanizing agent, a vulcanization accelerator, a vulcanization accelerator activator, a filler, an antioxidant, etc., that are added to the elastic member.

In this way, arranging an ink cartridge to include an ink containing bag which contains ink and a supply port section having an elastically deformable portion through which a hollow nozzle member is pierced from the side of an image forming device and arranging the supply port section to be directly held by the ink containing bag such that the hollow nozzle member penetrates through the supply port section and the ink containing bag to face the inside of the ink containing bag make it possible to keep the number of parts small and to prevent a contaminant from finding its way into the ink containing bag, which is being sealed up in the manufacturing process.

Figure 3:
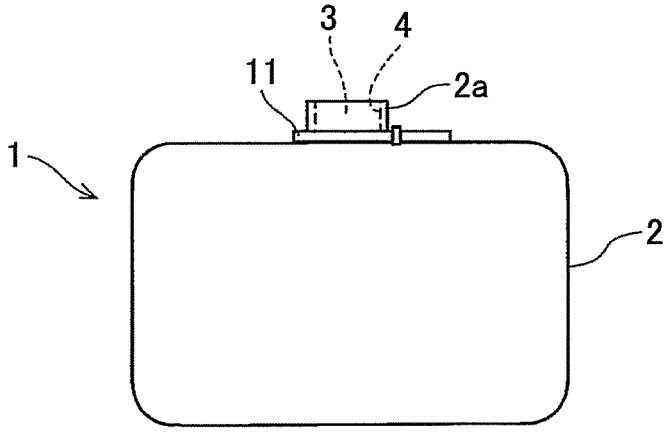
FIG. 3 is a schematic explanatory diagram which serves to explain a second embodiment of the ink cartridge according to the present invention.

Next, an ink cartridge according to a second embodiment of the present invention is described with reference to FIG. 3. FIG. 3 is a schematic explanatory diagram of the ink cartridge as described above.

The ink cartridge 1 has the fit-in section 2*a* of the ink containing bag 2 bound with the supply port section 3 with a binding band 11 to hold the supply port section 3 to the ink containing bag 2 in a sealed manner.

Figure 4:
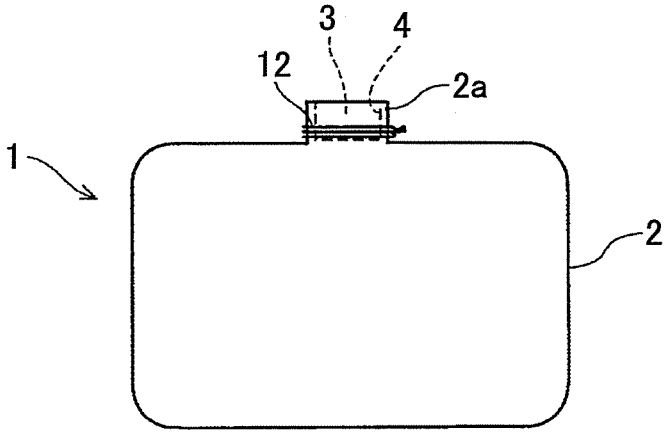
FIG. 4 is a schematic explanatory diagram which serves to explain a third embodiment of the ink cartridge according to the present invention.

Next, an ink cartridge according to a third embodiment of the present invention is described with reference to FIG. 4. FIG. 4 is a schematic explanatory diagram of the ink cartridge as described above.

The ink cartridge 1 has the fit-in section 2*a* of the ink containing bag 2 bound with the supply port section 3 with a metal wire member 12 to hold the supply port section 3 to the ink containing bag 2 in a sealed manner.

Next, an ink cartridge according to a fourth embodiment of the present invention is described with reference to FIG. 5. FIG. 5 is a schematic explanatory diagram of the ink cartridge as described above.

Figure 5A:
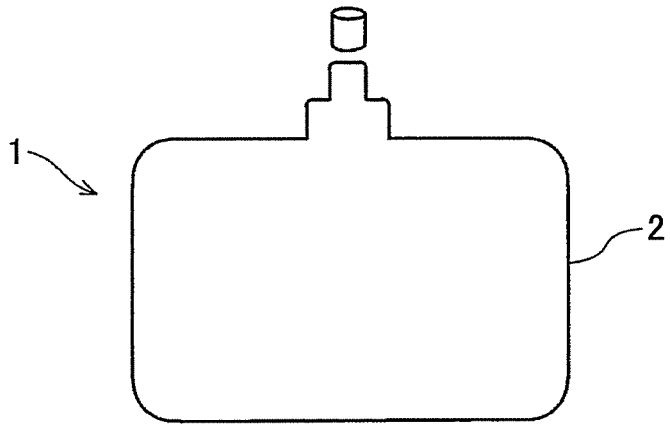
FIGS. 5A and 5B are schematic explanatory diagrams which serve to explain a fourth embodiment of the ink cartridge according to the present invention.
Figure 5B:
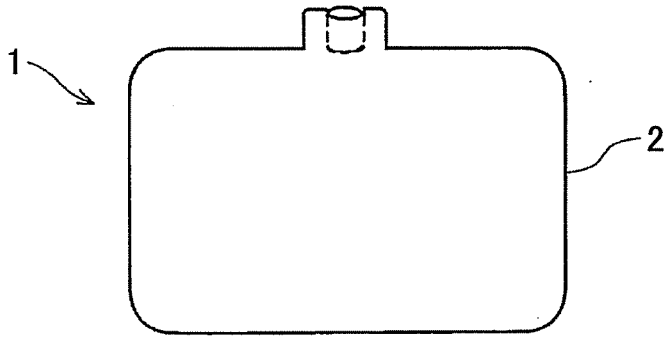

As shown in FIG. 5A, the ink containing bag 2 of the ink cartridge 1 has a fit-in section 2*a* having a portion 2*c* which, in a state before the supply port section 3 is fitted therein, protrudes in two nipple-shaped stages, and, as shown in FIG. 5B, the supply port section 3 pushes the portion 2*c*, so that the fit-in section 2*a* is dented and covers the outer periphery of the supply port section 3. In this case, the supply port section 3 as well as the fit-in section 2*a* of the ink containing bag 2 may be fixed with the binding band or the metal wire member as described in the second and third embodiments.

Figure 6:
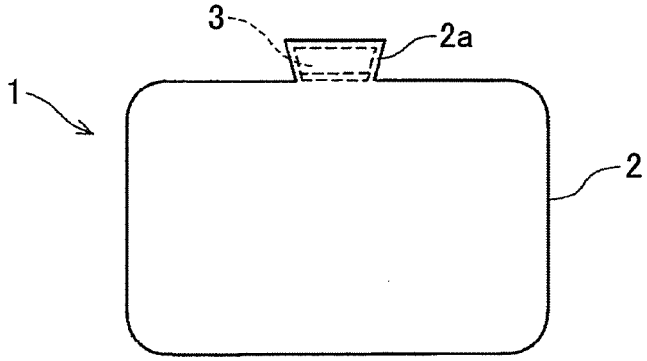
FIG. 6 is a schematic explanatory diagram which serves to explain a fifth embodiment of the ink cartridge according to the present invention.

Next, an ink cartridge according to a fifth embodiment of the present invention is described with reference to FIG. 6, which is a schematic explanatory diagram of the ink cartridge as described above.

The ink cartridge 1 wraps up, with the ink containing bag 2, the supply port section 3, which is held inside the ink containing bag 2 such that it does not come in contact with ink.

Here, with respect to the relationship between the supply port section and the liquid contact, as described above, even when the supply port section 3 is fitted outside the ink containing bag 2, the hollow nozzle member 5 pierces through after the ink cartridge 1 is loaded, so that the supply port section 3 comes into contact with the ink. However, an amount of the ink in contact is absolutely small and a period in contact is a period from when the ink cartridge 1 is loaded to when the ink of the ink cartridge 1 is used up (for example, around 6 months, which is a term of a guarantee), which period is a relatively short period. On the other hand, when the supply port section 3 of the ink cartridge 1 is fitted inside the ink containing bag 2, the amount of ink in contact is absolutely large and the period in contact is a period up to the use-by date (for example, 2 years) of the cartridge, which period is a relatively long period. Therefore, with the invention of the subject application, there is an advantage that high liquid contactability of the supply port section is not required because the supply port section is held with respect to the ink containing bag such that it does not come in contact with ink.

While the ink cartridge 1 according to each of the above-described embodiments has been described such that it does not have a hard casing outside thereof, it may also be arranged to tuck in the ink containing bag 2 within a hard casing 20 which is divided into two, a casing 21 and a casing 22. Such an arrangement provides for an improved ease of use when changing the ink cartridge and makes it possible to protect from external shocks.

Next, an ink cartridge according to a sixth embodiment of the present invention as well as the manufacturing process thereof are described with reference to FIG. 8, which is a schematic cross-sectional explanatory diagram which serves to explain the ink cartridge.

The ink cartridge 101, which is made of a resin material of low adherence, has an ink containing section 102 as a liquid containing section formed by blow molding and a supply port section 103 which is made of a flexible member through which a hollow nozzle member is pierced from the side of the image forming device body, the supply port section 103 being fixed, by welding or adhering, to a recess section 104 formed on a wall face of the ink containing section 102. For the blow molding, a direct blow molding, an injection blow molding, etc., may be used.

Figures 8A, 8B, 8C, 8D:
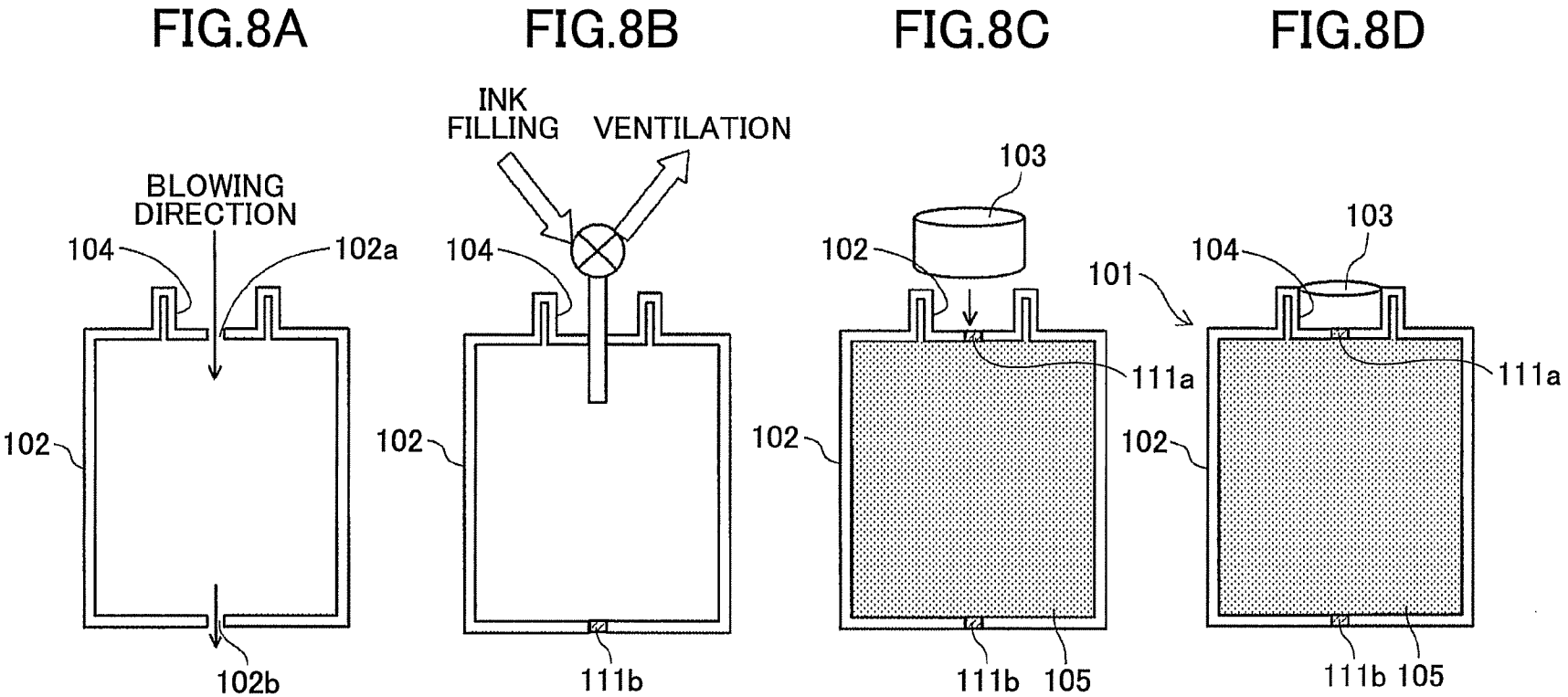
FIGS. 8A through 8D are schematic cross-sectional explanatory diagrams which serve to explain a sixth embodiment of the ink cartridge according to the present invention as well as a manufacturing process thereof.

For manufacturing the ink cartridge 101 as described above, first, as shown in FIG. 8A, the ink containing section 102 having the recess section 104 is formed by the direct blow molding or the injection blow molding; as shown in FIG. 8B, ink 105 is filled into the ink containing section 102 while ventilating therefrom; as shown in 8C, the supply port section 103 is pushed into the recess section 104 in a compressed manner to fix thereto by adhering or gluing; and as shown in FIG. 8D, the ink cartridge 101 is completed.

Here, while the thickness of the ink containing section 102 is not specifically limited as long as the quality of ink filled in is maintained and it is within a range that there is resistance to external shocks, it is preferable to be adjusted such that it takes a range of 100-1000 μm, and preferably a range of 300-600 μm.

Moreover, while a material of which the ink containing section 102 is made is preferably an olefine resin such as polyethylene, polypropylene, or poly ethylene terephthalate from aspects of cost, liquid contactability with ink, and strength, but it is not limited thereto. There is a great advantage with these resins which are easy to be molded, however, the fact that they are of low adherence may likely be an obstacle in mounting the flexible material.

A material of which a parison used for the ink containing section 102 is made may include the one type of resin of low adherence, or may have a layer structure including multiple types of resins. Moreover, it may be a structure having a metal thin film on the surface or for an intermediate layer. The metal thin-film layer is not particularly limited as long as it has an object of suppressing moisture permeability of the film, or has an object of providing the rigidity of the film to yield an advantage, but is preferably aluminum.

The ink containing section 102 formed by blow molding, which can be set as it is to the image forming device, may also be tucked in a hard casing (protective casing) in order to improve ease of use when changing the ink carrying container or to protect from external shocks.

For filling ink into the above-described ink containing section 102, after molding the ink containing section 102, a parison outflow bore 102*b* is closed and the ink is filled from a parison inflow bore 102*a*, for example. As for ink filling, after ventilating air within the ink containing section 102, deaerated ink may be filled, or, after filling ink, ink in the ink containing section 102 may be deaerated and the inflow bore 102*a* may be welded, or the inside of the ink containing section 102 may be replaced by nitrogen first and then the ink may be filled in while taking out the nitrogen within the ink containing section 102 therefrom. Moreover, the gas inflow bore 102*a* at the time of the blow molding of the ink containing section 102 is sealed with the heat welding section 111*a* after the ink filling, while the gas outflow bore 102*b* is sealed with the heat welding section 111*b* before the ink filling. Moreover, it may be arranged for the ink to be filled in from the gas outflow bore 102*b*.

Then, after the ink is filled into the ink containing section 102, the supply port section 103 is mounted to a portion of the recess section 104 of the ink containing section 102.

The supply port section 103 is not specifically limited as long as it includes an elastic member (elastic part) in at least a portion thereof. The elastic member may preferably include a rubber member and may use, as a composition, in particular, a silicone rubber, fluorine rubber, butyl rubber, an ethylene-propylene rubber (EPM or EPDM), etc. Among others, when taking into account liquid contactability with ink, depending on the composition of the ink, the EPDM is preferable for being superior in heat-resistance, weather-resistance, and ozone-resistance. Moreover, for a structure which is to be in contact with ink over a long term, a vulcanizing agent, a vulcanization accelerator, a vulcanization accelerator activator, a filler, an antioxidant, etc., may be added to an elastic member.

Moreover, it is preferable for the outer periphery (outer peripheral diameter) to be a little larger than the inner periphery (inner peripheral diameter) of the recess section 104 formed on the ink containing section 102. By making the size of the supply port section 104 a little larger, pressure is exerted in the compressing direction of the supply port section 103 when the recess section 104 of the ink containing section 102 is mounted, making it possible to prevent ink from leaking even when the hollow nozzle member for supplying ink is taken out or stuck in.

Then, the supply port section 103 is pushed into the recess section 104 of the ink containing section 102. Then, the outer periphery (outer peripheral diameter) of the supply port section 103 is formed to be larger than the inner periphery (inner peripheral diameter) of the recess section 104, so that the supply port section is fitted thereinto in a compressed state. In this state, the pressure exerted on the supply port section 103 is preferably a pressure of a degree such that an inserting bore closes when a hollow nozzle member is taken out and stuck in. Moreover, a portion at which a portion into which a hollow nozzle member is inserted that is of an ink containing section 102, and a supply port section 103 is welded or adhered.

In this way, an ink containing section which is made of resin of low adherence is formed by blow molding, which is mass productive, and a supply port section which is made of an elastic member is configured in a simple manner such that it is fixed, by molding or adhering, to a recess member formed on a wall face of the ink containing section, making it possible to achieve low cost. Moreover, as the sealed up hollow-shaped ink containing section may be integrally formed by blow molding, it is sealed up when it is not in use, and it is arranged such that the supply port section is mounted from the outside of the ink containing body, making it possible to reduce the dirt, etc., finding its way thereinto. Moreover, as the supply port section is inserted into the recess section of the ink containing section, even when the ink containing section is made of a resin of low adherence, subsequent adhering and welding may be performed easily.

Moreover, a sealed up hollow-shaped ink containing section may be integrally formed using blow molding, and a supply port section which is made of an elastic member is arranged to be welded or adhered to a recess section formed on a wall face of the ink containing section, making it possible to prevent ink from leaking. Furthermore, by the blow molding, a three dimensional ink containing section may be formed and fixing thereof is easy unlike the bag-shaped one, providing for simple fixing even when it is not tucked in a protective casing, making it possible to tuck in and take out with respect to the imaging forming device body even without the protective casing.

Moreover, a portion to be inserted into a recess section of the supply port section is made of an elastic member and is inserted into the recess section by pushing thereinto, the supply port section follows the tucking in and taking out of the nozzle member, making it possible to prevent ink from leaking after the nozzle member is taken out.

Furthermore, as described above, a gas inflow bore trace or outflow bore trace at the time of blow molding in a parison, which is a raw material for blow molding, is located at a recess section of the ink containing section that is covered by the supply port section, so that a portion of the parison bore that has a only possibility of liquid leaking is blocked by the supply port section, making it possible to more accurately prevent liquid leaking and making it unnecessary to provide for processing for sealing up the ink containing section.

Moreover, a gas inflow bore trace or outflow bore trace at the time of blow molding is arranged to be shaped as a bore for injecting ink (liquid) thereinto, making possible for the mounting process of the supply port section to also serve as the sealing process after ink injection, providing for simplifying the processes and decreasing cost.

Figure 9:
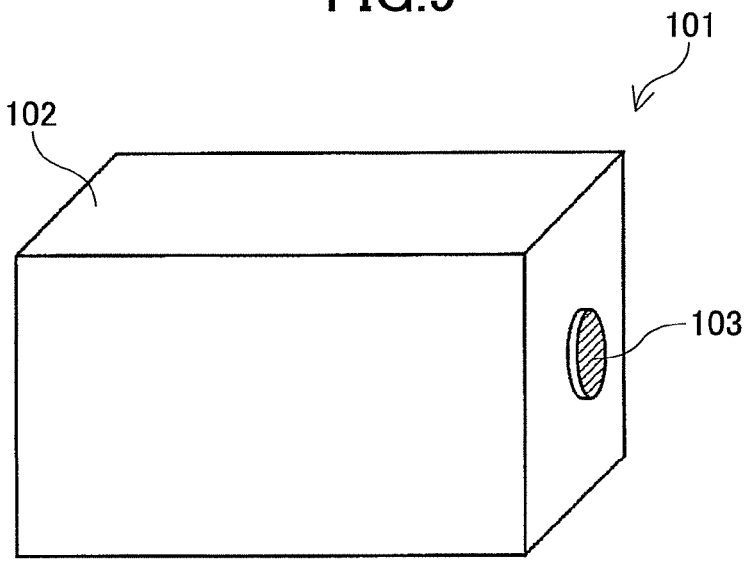
FIG. 9 is an external perspective explanatory diagram which serves to explain a seventh embodiment of the ink cartridge according to the present invention.
Figure 10:
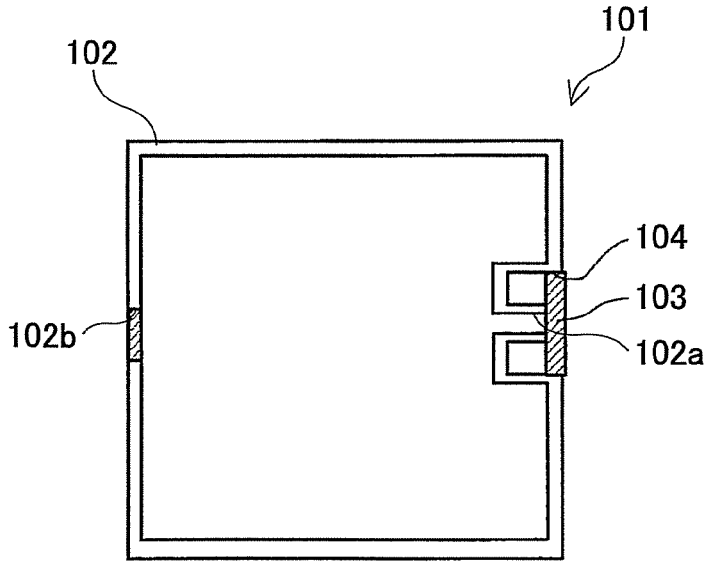
FIG. 10 is a schematic cross-sectional explanatory diagram which serves to explain the same.
Figure 11:
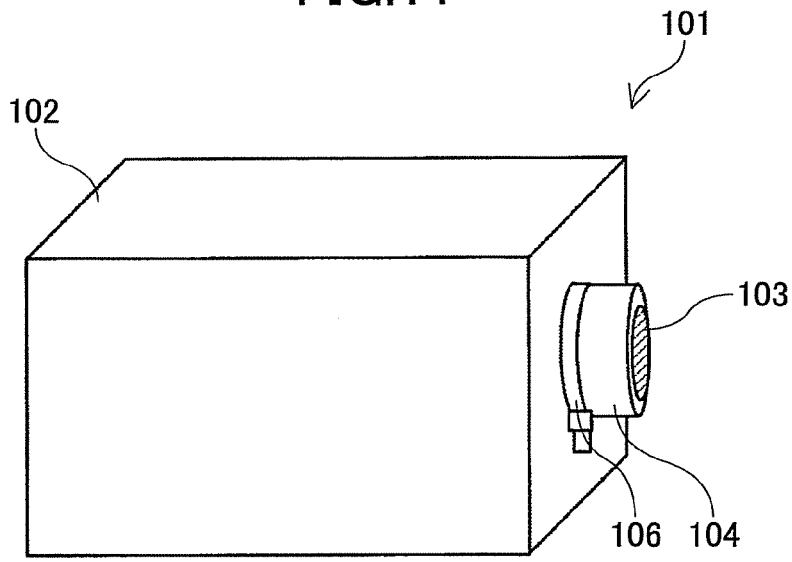
FIG. 11 is an external perspective explanatory diagram which serves to explain an eighth embodiment of the ink cartridge according to the present invention.

Next, an ink cartridge according to a seventh embodiment of the present invention is described with reference to FIGS. 9 and 10. FIG. 9 is an external perspective explanatory diagram which serves to explain the ink cartridge, while FIG. 10 is a schematic cross-sectional explanatory diagram for the same.

Here, a recess section 104 is formed which faces the inside from an external face of the ink containing section 102, and a supply port section 103 is mounted within the recess section 104.

Next, an ink cartridge according to an eighth embodiment of the present invention is described with reference to FIG.

11, which is an external perspective explanatory diagram which serves to explain the same ink cartridge.

This ink cartridge, which is made of a resin material of low adherence, includes an ink containing section 102 which is formed by flow molding and a member 103, a portion of which is formed of an elastic material, a hollow nozzle member to pierce therethrough from the side of the image forming device body. The supply port section 103 is arranged within a recess section 104 which is formed on a wall face of the ink containing section 102. At least a portion of the supply port section 103 is formed of an elastic material, which is tightened with a binding band 106 as a member which tightens from an outer periphery of the recess section 104 with the elastic member being compressed within the ink containing section 102.

In this way, a supply port section is fixed to a recess section of an ink containing section with a tightening member, making it possible to securely fix the supply port section to the ink containing section made of resin of low adherence.

In this case, it is preferable that the supply port section 103 is adhered (or welded) to a portion through which a hollow nozzle member of the ink containing section 102 pierces and the surrounding thereof. In this way, it is made possible to securely prevent ink from leaking from a portion through which a hollow nozzle member of the ink containing section 102 pierces by the hollow nozzle member being taken out and tucked in.

Figure 12:
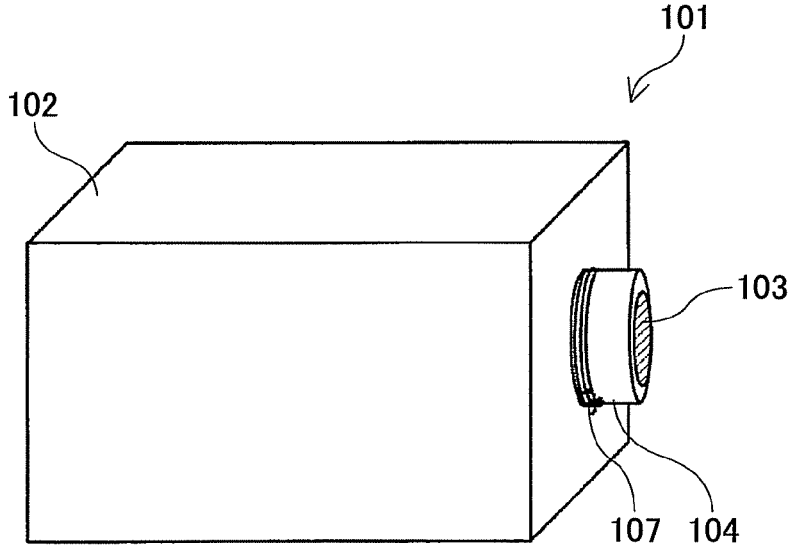
FIG. 12 is an external perspective explanatory diagram which serves to explain a ninth embodiment of the ink cartridge according to the present invention.

Next, an ink cartridge according to a ninth embodiment of the present invention is described with reference to FIG. 12, which is an external perspective explanatory diagram which serves to explain the same ink cartridge. Here, a wire member 107 which is deformable is used as a tightening member for the above-described eighth embodiment.

Figure 13:
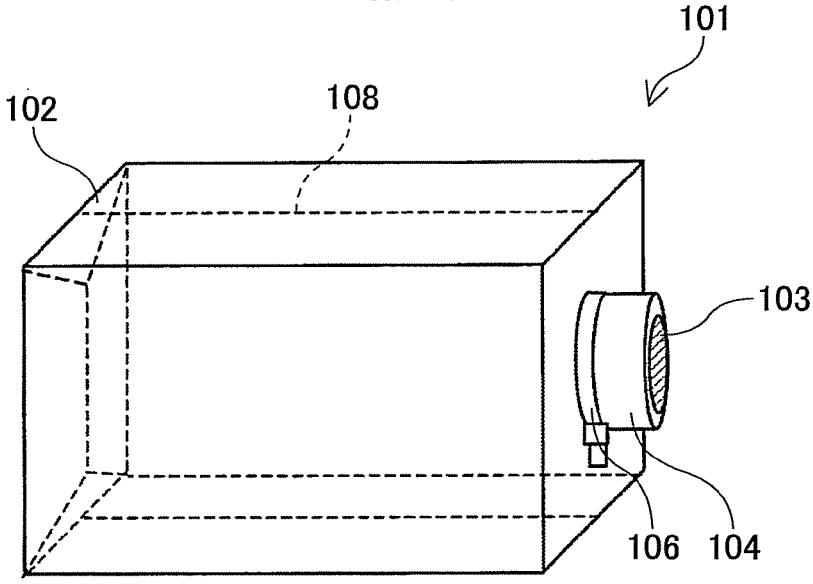
FIG. 13 is an external perspective explanatory diagram which serves to explain a tenth embodiment of the ink cartridge according to the present invention.

Next, an ink cartridge according to a tenth embodiment of the present invention is described with reference to FIG. 13, which is an external perspective explanatory diagram which serves to explain the same ink cartridge.

Here, a fold 108 is collapsibly formed at the ink containing section 102 of the eighth embodiment at the broken line location.

As a method of forming the fold 108 at the ink containing section 102, a portion to be the fold may be formed as a mold for molding a parison or a portion to be the fold may be formed at a mold to which the parison is to be put in.

As the ink containing section 102 includes the fold 108, the ink is supplied to the side of the image forming device body, so that the ink containing section 102 compresses, following a decrease in the remaining quantity, providing for a decrease in leftover ink and making it possible to supply the ink smoothly.

Figure 14:
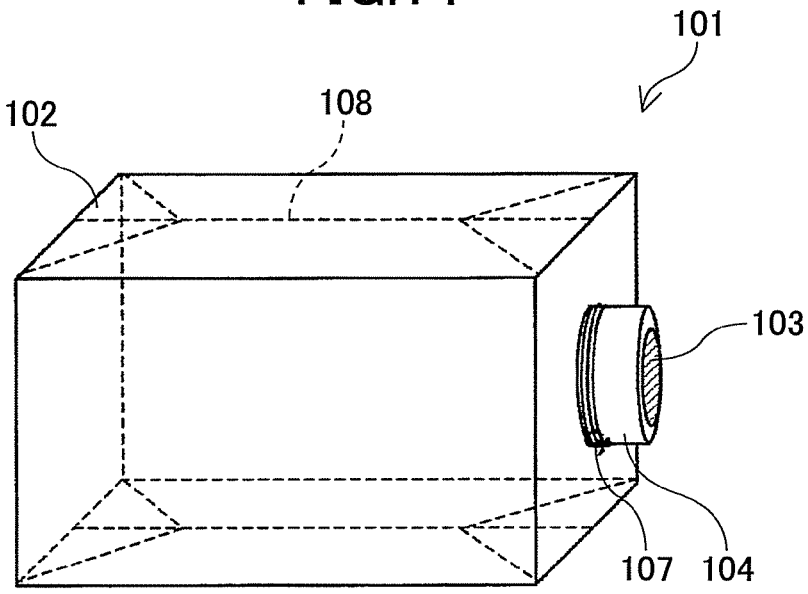
FIG. 14 is an external perspective explanatory diagram which serves to explain an eleventh embodiment of the ink cartridge according to the present invention.

Next, an ink cartridge according to an eleventh embodiment of the present invention is described with reference to FIG. 14, which is an external perspective explanatory diagram which serves to explain the same ink cartridge.

Here, a fold 108 is collapsibly formed at the ink containing section 102 of the ninth embodiment at the broken line location.

As previously described, an ink cartridge (a liquid carrying container) according to embodiments including the sixth embodiment and thereafter has an ink containing section (a liquid containing section), which has a shape close to a cuboid when it has yet to be used, and is easy to be set to the image forming device without a hard casing (protective casing). However, it may also be contained in the hard casing for increasing the ease-of-use at the time of replacing the ink carrying container or for the purpose of protecting from external shocks. While the hard casing is not particularly limited with respect to material or structure as long as it is resistant to the external shocks, it preferably has a structure to take hold of.

Figure 15:
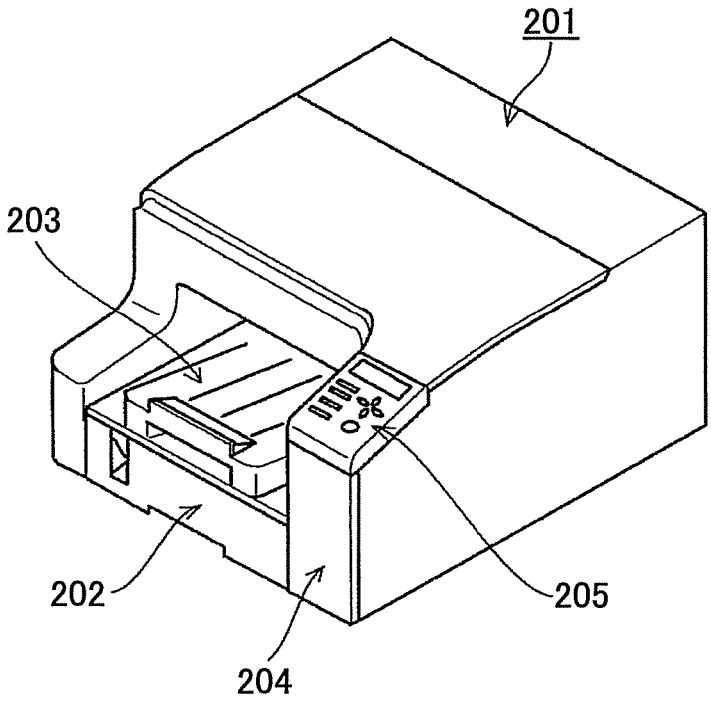
FIG. 15 is a perspective explanatory diagram illustrating an example of an image forming device according to the present invention that includes an ink cartridge according to the present invention.
Figure 16:
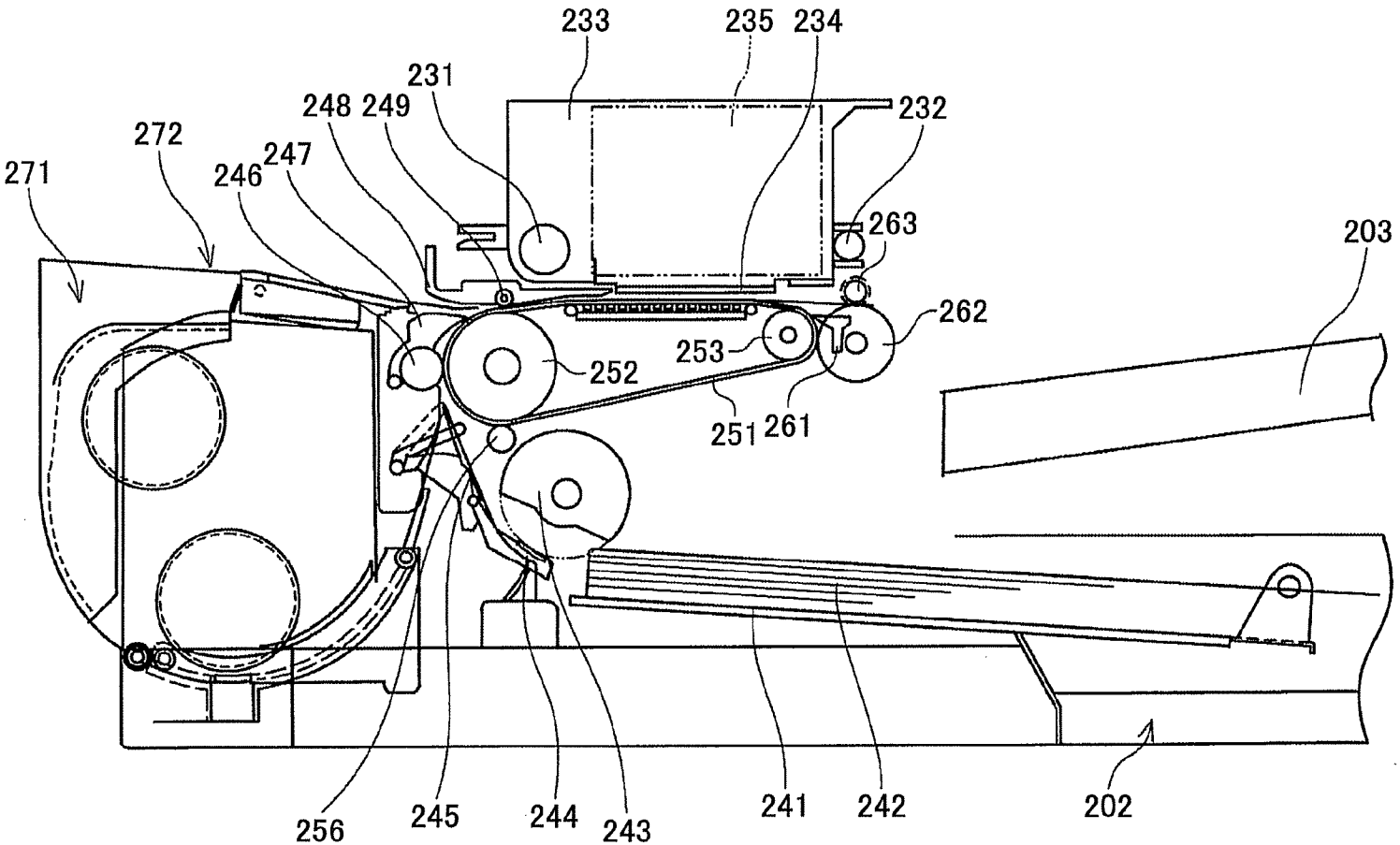
FIG. 16 is a lateral explanatory diagram illustrating an overview of a machinery section of the device.
Figure 17:
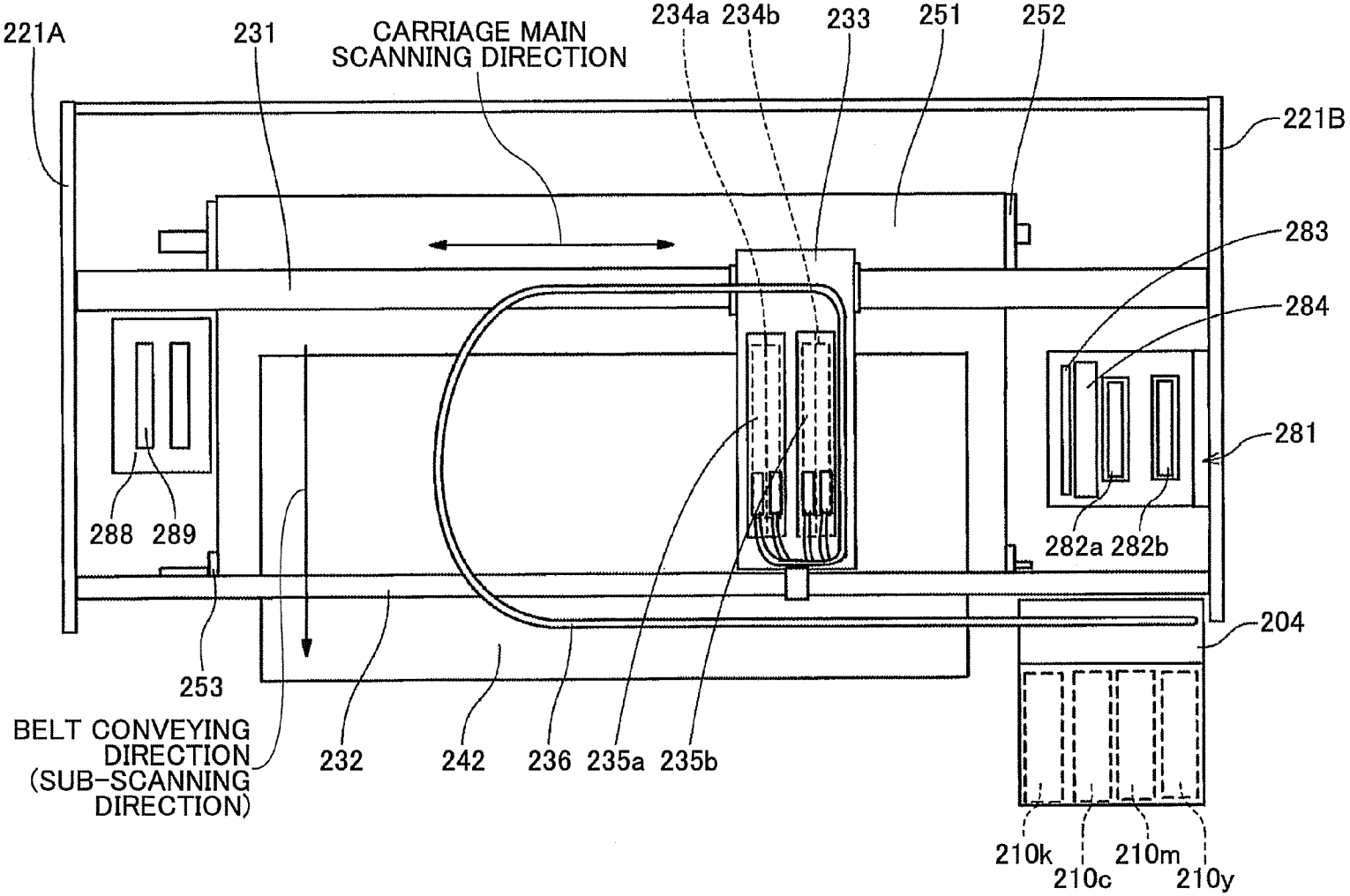
FIG. 17 is a feature plane explanatory diagram for the same.

Next, an example of an image forming device according to the present invention that uses an ink cartridge according to the present invention is explained with reference to FIGS. 15 to 17. FIG. 15 is an external perspective explanatory diagram of the same image forming device, FIG. 16 is a lateral explanatory diagram illustrating an overview of a machinery section of the same image forming device, and FIG. 17 is a feature plane explanatory diagram for the same.

The image forming device, which is a serial inkjet recording device, includes a device body 201, a paper-supply cassette 202 which can be pulled out to a predetermined sheet replenishment location while still being loaded in the device body 201, and a paper discharge tray 203 which serves as a lid member for the paper-supply cassette 202 and which is oscillatably mounted to the device body 201 to make it possible to open and close an upper portion of the paper-supply cassette 202. In the paper-supply cassette 202, sheets to be supplied within the device body 1 are stocked, while for the paper discharge tray 203, sheets on which images are recorded (formed) are stocked. Moreover, on the side of one edge of a front face of the device body 201, a cartridge loading section 204 for loading the ink cartridge according to the present invention is included, an upper face of the cartridge loading section 204 being arranged as an operation/display section 205 provided with an operation button and a display device.

Then, within the device body 201, a carriage 233 is held to be able to slide freely main and sub guiding rods 231 and 232, which are guiding members laterally bridged across left and right side plates 221A and 221B and moves and scans, by a main-scanning motor (not shown) in the direction shown with an arrow (carriage main-scanning direction) via a timing belt.

The carriage 233 has recording heads 234*a* and 234*b* (called "recording heads 234" when not distinguishing therebetween) including liquid discharging heads according to the present invention that are for discharging ink droplets of each of colors of yellow (Y), cyan (C), magenta (M), and black (K), which recording heads having a nozzle sequence including multiple nozzles that is arranged in a sub scanning direction which is orthogonal to the main scanning direction and being mounted with the ink droplet discharging direction facing downwards.

The recording heads 234 have respectively two nozzle sequences, with one of the nozzle sequences of the recording head 234*a* discharging a black (K) droplet, the other of the nozzle sequences of the recording head 234*a* discharging a cyan (C) droplet, one of the nozzle sequences of the recording head 234*b* discharging a magenta (M) droplet, and the other of the nozzle sequences of the recording head 234*b* discharging a yellow (Y) droplet.

Figure 7:
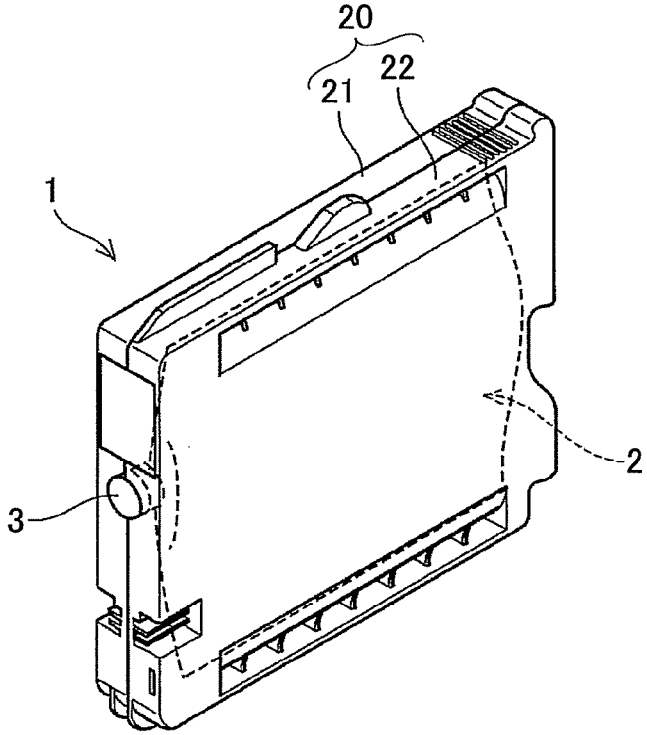
FIG. 7 is a perspective explanatory diagram of the ink cartridge being tucked in a hard casing according to the present invention.

Moreover, the carriage 233 is mounted with head tanks 235*a*, 235*b* (called "head tank 235 when not distinguishing therebetween) for supplying ink of each color in correspondence with the nozzle sequence of the recording head 234. To this subtank 235 is replenished ink of each color from an ink cartridge 210 (shown with a hard casing tuck-in type in FIG. 7) of each color according to the present invention via a supply tube 236 of each color.

On the other hand, as a paper-supply section for supplying sheets 242 loaded on a sheet loading section 241 (a pressure plate) for a paper-supply cassette 202 is provided a crescent roller (a paper-supply roller) 243 which feeds, on a sheet by sheet basis, the sheets 242 from the sheet loading section 241 and a separation pad 244 which opposes the paper-supply roller 243 and which is made of a material with a large coefficient of friction, which separation pad 244 is biased to the paper-supply roller 243 side.

Then, in order to feed, into the lower side of the recording head 234, the sheets 242 supplied from the paper-supply section, a guide member 245 which guides the sheets 242, a counter roller 246, a conveying guide member 247, and a pressing member 248 which has a tip pressure roller 249, as well as a conveying belt 251 which is a conveying unit for electrostatically adsorbing the sheets 242 supplied to convey the electrostatically adsorbed sheets 242 at a location opposing the recording head 234.

This conveying belt 251, which is an endless belt, is arranged to be built between a conveying roller 252 and a tension roller 253 to revolve in the belt-conveying direction (sub-scanning direction). Moreover, a charging roller 256 is provided which is a charging unit for charging the surface of the conveying belt 251. This charging roller 256, which is in contact with a surface of the conveying belt 251, is arranged such that it rotates following a rotational movement of the conveying belt 251. This conveying belt 251 orbitally moves in the belt conveying direction by the conveying roller 252 being rotationally driven via a timing unit with a sub-scanning motor (not shown).

Moreover, as a paper-output section for outputting sheets 242 recorded with the recording head 234, a separating claw 261 for separating the sheets 242 from the conveying belt 251, and a paper-output roller 262 and a paper-output roller 263 are provided, and a paper-output tray 203 is provided below the paper-output roller 262.

Furthermore, a double face unit 271 is removably mounted on a back face section of the device body 201. This double face unit 271 takes in sheets 242 returned in a reverse direction rotation of the conveying belt 251 to reverse the sheets so as to supply the sheets again between the counter roller 246 and the conveying belt 251. Moreover, the upper face of this double face unit 271 is arranged to be a manual bypass tray 272.

Furthermore, in a non-printing area of one side of the scanning direction of the carriage 233, a maintenance and recovery mechanism 281 is arranged which is a device for maintaining and recovering a head according to the present invention that includes a recovery unit for maintaining and recovering a state of a nozzle of the recording head 234. This maintenance and recovery mechanism 281 includes caps 282*a*, 282*b* (called "cap 282" when not distinguishing therebetween) for capping each nozzle face of the recording head 234, a wiper blade 283, which is a blade member for wiping the nozzle head, and a non-contributing discharge receiver 284 which receives a droplet when a droplet which does not contribute to recording is discharged in order to drain bodied-up recording liquid, etc.

Moreover, in a non-printing area of the other side of the scanning direction of the carriage 233, an ink recovering unit (non-contributing discharge receiver) 288 is arranged which is a liquid recovering container for receiving a droplet when a droplet which does not contribute to recording is discharged in order to drain bodied-up recording liquid during recording, etc., which ink recovering unit 288 being provided with an opening section 289 along a nozzle sequence direction of the recording head 234.

In the image forming device which is configured as described above, the sheets 242 are supplied from the paper-supply cassette 202 separately on a sheet by sheet basis, the sheets 242 supplied substantially vertically upward are guided with the guide 245, are put between the conveying belt 251 and the counter roller 246 to be conveyed, and further have the tip thereof guided with the conveying guide 237 to be pressed against the conveying belt 251, are turned substantially 90 degree with respect to the conveying direction thereof, are adsorbed on the charged conveying belt 251, and the sheets 242 are conveyed in the sub-scanning direction with a revolving movement of the conveying belt 251.

Then, the recording head 234 is driven according to an image signal while moving the carriage 233 to discharge an ink droplet onto sheets 242 at rest to record what amounts to one line, and recording for the following line is performed after the sheets 242 are conveyed for a predetermined amount. When a recording termination signal or a signal that a trailing edge of the sheet 242 has reached the recording area is received, the recording operation is terminated, so that the sheets 242 are output to the paper-output tray 203.

This image forming device, which has an ink cartridge according to the invention removably mounted thereto, makes it possible to achieve cost reduction.

The present application is based on the Japanese Priority Application No. 2009-200053 filed on Aug. 31, 2009, and the Japanese Priority Application No. 2009-064346 filed on Mar. 17, 2009, the entire contents of which are hereby incorporated by reference.

The invention claimed is:

1. A liquid carrying container which is removably mounted to a body of an image forming device, comprising:

a liquid containing hag which contains liquid, the liquid containing bag including a liquid-storage section that is sealed and a recess section external to the sealed liquid-storage section; and a supply port section which has an elastically deformable portion through which a hollow nozzle member is pierced from the side of the image forming device, wherein the recess section and the sealed liquid-storage section are integrally formed of a flexible film member, and the supply port section is directly held within the recess section formed external to the sealed liquid-storage section of the liquid containing bag, and the hollow nozzle member penetrates through the supply port section and the sealed liquid-storage section of the liquid containing bag to face inside the liquid containing bag.

2. The liquid carrying container as claimed in claim 1, wherein the supply port section is fixed to the recess section formed at the liquid containing bag by being fitted thereinto.

3. The liquid carrying container as claimed in claim 2, wherein the supply port section is fixed to the recess section of the liquid containing bag by adhering, welding, or a tightening member.

4. The liquid carrying container as claimed in claim 1, wherein the recess section of the liquid containing bag is formed to push therein an externally protruding portion.

5. The liquid carrying container as claimed in claim 1, wherein the supply port section is held inside the liquid containing hag such that it does not come in contact with the liquid.

6. An image forming device, wherein the image forming device has removably mounted thereto the liquid carrying container as claimed in claim 1.

7. The liquid carrying container as claimed in claim 1, wherein the supply port section has a shape that complements a shape of the recess section.

8. The liquid carrying container as claimed in claim 1, wherein the supply port section is held within the recess section complementarily and does not extend outside of the recess section.

9. A liquid carrying container which is removably mounted to a body of an image forming device, comprising:

a liquid containing member including a liquid containing section that is sealed and a recess section external to the sealed liquid-storage section, the liquid containing section and the recess section having been made of a resin material of low adherence and integrally formed by blow molding; and a supply port section through which a hollow nozzle member is pierced from the side of the body of the image forming device, wherein the supply port section is welded or adhered to the recess section formed external to the sealed liquid-storage section of the liquid containing section, and the hollow nozzle member penetrates through the supply port section and the sealed liquid-storage section of the liquid containing member to face inside the liquid containing member.

10. The liquid carrying container as claimed in claim 9, wherein the supply port section has a portion which is fitted into the recess section formed by an elastic member, and an outer peripheral diameter of the supply port section is larger than an inner peripheral diameter of the recess section, and the supply port section is pushed into the recess section.

11. The liquid carrying container as claimed in claim 9, wherein a gas inflow bore trace or a gas outflow bore trace at the time of the blow molding in a parison which is a raw material of the blow molding is located at a portion which is covered with the supply port section of the recess section of the liquid containing section.

12. The liquid carrying container as claimed in claim 11, wherein the inflow bore trace or the outflow bore trace is shaped in a bore for injecting liquid.

13. A liquid carrying container which is removably mounted to a body of an image forming device, comprising:

a liquid containing member including a liquid containing section that is sealed and a recess section external to the sealed liquid-storage section, the liquid containing section and the recess section having been made of a resin material of low adherence and integrally formed by blow molding; and a supply port section through which a hollow nozzle member is pierced from the side of the body of the image forming device, wherein the supply port section is arranged within the recess section formed external to the sealed liquid-storage section of the liquid containing section, and the supply port section has at least a portion thereof made of an elastic member and the elastic member is tightened with a tightening member from an outer periphery of the recess section while being compressed within the liquid containing section, and the hollow nozzle member penetrates through the supply port section and the sealed liquid-storage section of the liquid containing member to face inside the liquid containing member.

14. The liquid carrying container as claimed in claim 13, wherein a gas inflow bore trace or a gas outflow bore trace at the time of the blow molding in a parison as a raw material of the blow molding is located at a portion covered with the supply port section of the recess section of the liquid containing section.

15. The liquid carrying container as claimed in claim 14, wherein the inflow bore trace or the outflow bore trace is shaped as a bore for injecting liquid.

16. The liquid carrying container as claimed in claim 13, wherein the supply port section is adhered to or welded to a portion through which the hollow nozzle member of the liquid containing section pierces and the surroundings thereof.

17. The liquid carrying container as claimed in claim 13, wherein the tightening member is a binding band or deformable wire member.

18. The liquid carrying container as claimed in claim 13, wherein a fold is formed on the liquid containing section.

* * * * *